US007677600B2

(12) United States Patent
Johnson

(10) Patent No.: US 7,677,600 B2
(45) Date of Patent: Mar. 16, 2010

(54) ROLLER SKI

(76) Inventor: Lennart B. Johnson, 224 Federal Hill Rd., Milford, NH (US) 03055

( * ) Notice: Subject to any disclaimer, the term of this patent is extended or adjusted under 35 U.S.C. 154(b) by 0 days.

(21) Appl. No.: 11/978,418

(22) Filed: Oct. 29, 2007

(65) Prior Publication Data

US 2009/0134589 A1 May 28, 2009

Related U.S. Application Data

(63) Continuation of application No. 11/145,800, filed on Jun. 6, 2005, now abandoned.

(51) Int. Cl.
*A63C 17/14* (2006.01)

(52) U.S. Cl. ..... 280/842; 280/11.214

(58) Field of Classification Search ..... 280/842, 280/816, 11.36, 11.204, 11.211, 11.214, 280/11.215
See application file for complete search history.

(56) References Cited

U.S. PATENT DOCUMENTS

| | | | | |
|---|---|---|---|---|
| 1,402,010 | A * | 1/1922 | Ormiston | 280/11.201 |
| 3,696,334 | A * | 10/1972 | Demeter | 340/432 |
| 3,767,220 | A * | 10/1973 | Peterson | 280/842 |
| 3,790,187 | A * | 2/1974 | Radu et al. | 280/11.201 |
| 4,033,596 | A * | 7/1977 | Andorsen et al. | 280/842 |
| 4,072,317 | A * | 2/1978 | Pommerening | 280/11.224 |
| 4,333,237 | A * | 6/1982 | Carbone | 33/501 |
| 5,704,617 | A * | 1/1998 | Stoughton et al. | 280/11.214 |
| 5,924,704 | A | 7/1999 | Johnson | |
| 6,082,768 | A * | 7/2000 | Johnson | 280/842 |
| 6,676,138 | B1 * | 1/2004 | Rosso | 280/11.221 |

FOREIGN PATENT DOCUMENTS

| | | | | |
|---|---|---|---|---|
| DE | 29 25 555 | A1 * | 1/1981 | 280/842 |

* cited by examiner

*Primary Examiner*—Frank B Vanaman
(74) *Attorney, Agent, or Firm*—Joseph E. Funk

(57) ABSTRACT

In-one aspect, a leg activated brake for a foot supporting rolling device, such as a roller ski. Roller skis generally have one wheel mounted to each end of the foot supporting frame which houses a ski binding for the skier's boot. The brake system mounts to the frame of the roller ski and when the brake is activated by the leg, the brake applies frictional force to the rear wheel to stop the roller ski.

8 Claims, 5 Drawing Sheets

ROLLER SKI

CROSS REFERENCE TO RELATED APPLICATION

The present continuation patent application relates to, and is entitled to the benefit of the earlier filing date and priority of U.S. patent application Ser. No. 11/145,800 having a filing date of Jun. 6, 2005 now abandoned, entitled "Roller Ski", the entirety of which is incorporated herein by reference.

FIELD OF THE INVENTION

This invention relates to a brake assembly for a foot-mounted wheeled vehicles such as a roller ski.

BACKGROUND OF THE INVENTION

The present invention relates to roller skis. Roller skis are used by skiers in the non snow seasons, mainly for training by competitive cross country and Alpine skiers. Roller skis have a frame which supports the foot, generally with one wheel in front and one wheel in the back. Mounted to the frame is a ski binding for attaching the ski boot to the frame as shown in FIG. 1. Contemporary roller skis have wheels from about 65 to 150 mm in diameter and the foot supporting frames vary in length from about 450 to 700 mm.

Roller skis have been commercially available for over 35 years but, until the present invention, no one has offered a leg activated brake for conventional roller skis. Prior art includes hand activated brakes and using ski poles to stop the skis. Braking by a ski pole is unsafe and not effective. To brake with a hand activated brake is difficult without the skier loosing his balance and in an emergency the brake cannot be activated quickly enough as the skier has to reach, with his hand holding the ski pole, the brake pull handle which is generally attached to the skiers leg as depicted in FIG. 12.

In order for the skier to preserve balance the skier should have both hands on the ski poles and the body should be in a balanced ski position. For safety and rapid braking in an emergency situation, the brake should be able to be activated by the leg when the skier is in a stable position. This position is often referred to as the "Telemark" position and is shown in FIG. 11. In this position the braking leg acts a brace when slowing down preventing the skier from falling forward from the forces imposed on the body when braking. When roller skiing the leg positions shown in FIG. 11 are used when braking.

U.S. Pat. No. 6,082,768 describes a leg activated brake for roller skis, where the brake is an integral part of the foot platform and the roller ski design. U.S. Pat. No. 4,033,596 describes a foot activated brake for roller skis with two, side by side, wheels in the back, but the patent does not provide a method for the brake to be adjusted for different wheels, ski bindings, ski boots, roller ski frames and different users' anatomy. Because Pat. No. 4,033,596 did not provide solutions for these variables, no commercial leg activated brakes were produced for conventional roller skis prior to the invention described herein.

U.S. Pat. No. 5,924,704 describes another foot activated brake for roller skis but, as in Pat. No. 6,082,768, the brake is not suitable for mounting to conventional roller ski frames.

SUMMARY OF THE INVENTION

The main object of the invention is to provide a braking system for conventional roller skis that can be leg activated when the skier is in a stable position . The brake structure has members for vertical and horizontal adjustments so the brake structure can be adapted to a variety of boot designs, boot sizes, frame structures, ski binding mounting locations, wheel sizes and the user's anatomy.

Another objective of the invention is to provide a method of mounting the brake to the foot supporting frame of conventional roller skis in such a manner that the frame retains its structural integrity and the brake structure does not interfere with the ski binding or the ski boot.

The brake structure of the invention is such that it can be mounted to the roller ski frame with conventional screws and it utilizes minimal space. In one embodiment the brake can also be folded across the ski binding.

Other advantages of the invention will be apparent from the following descriptions of the embodiments thereof and from the claims.

DESCRIPTION OF THE INVENTION

Figure 1:
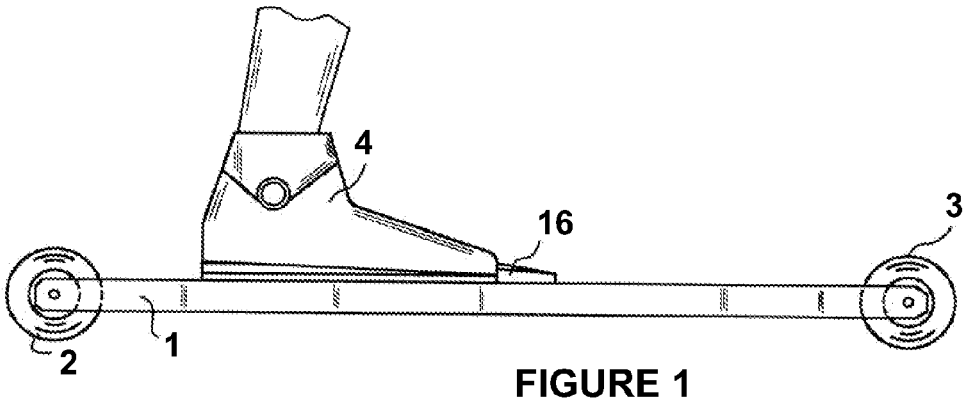
FIGURE 1 (PRIOR ART)
FIG. 1 is a side view of a conventional roller ski with small wheels and a medium size boot.

Referring to FIGS. 2, 3, 4, and 5 the roller ski includes a foot frame support 1, to which is mounted a single rear wheel 2 and a single front wheel 3. Mounted to the frame is ski binding 16, to which is attached ski boot 4.

The roller ski further includes a U shaped bottom support member 17, which is fastened to the frame 1. Pivotally mounted to bottom support member 17, via pivot pin 8, is the lower member 6 to which is mounted the upper articulated member 7 via mounting screws 10.

Mounted to member 7 is the yoke member 14 which is fastened by mounting screws 13. Mounted to the lower member 6 is brake pad 5. Mounted to U shaped support member 17 and to member 6 is extension spring 15.

Figure 2:
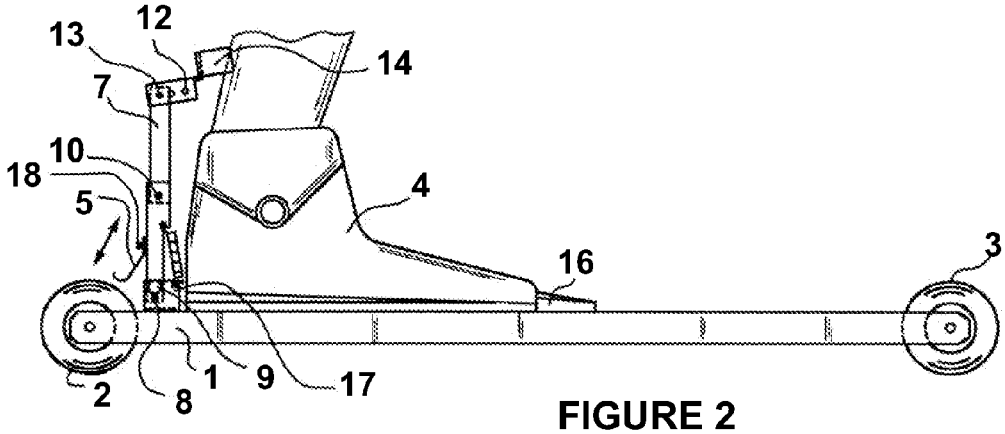
FIG. 2 is a side view of a roller ski with small conventional wheels and a large boot according to the invention.
Figure 3:
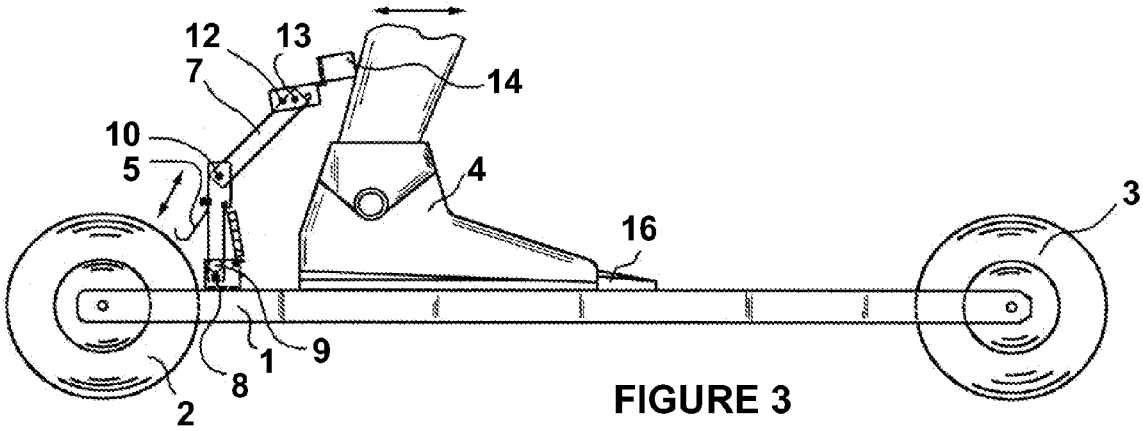
FIG. 3 is a side view of a roller ski with large conventional wheels and a small boot according to the invention.
Figure 4:
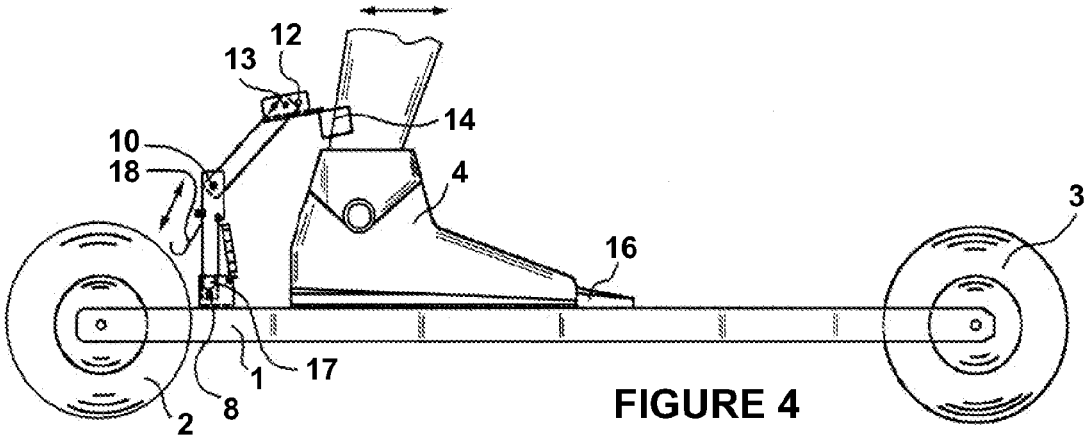
FIG. 4 is a side view of the roller ski with upper brake member rotated 180 degrees according to the invention.

When the brake is in the upward position for braking as shown in FIGS. 2, 3, and 4, the brake is held in the upright position by pivot pin 8, spring loaded plunger 9 and extension spring 15.

When the skier's leg pushes backward against yoke 14, the joined structure pivots on pin 8, moving the brake pad against the wheel and stopping the roller ski. As the skier removes the leg pressure from yoke 14, the spring tension returns member 6, of the connected structure, to a vertical position where it is stopped by plunger pin 9, the plunger being mounted to U shaped support 17 which is fastened to frame 1.

For proper balance the binding 16, must be mounted in a specific position which is dependent on the boot size, the ski weight and the length of the ski. FIG. 2 depicts the position of member 7 and yoke 14 when the skier has a large boot and frame 1 is fitted with small wheels 2 and 3.

FIG. 3 shows the position of member 7 and yoke 14 when the skier has a small boot and frame 1 has large wheels 2 and 3. FIG. 4 shows the position of yoke member 14 turned 180 degrees so it contacts the leg in a lower position, which is preferred by some users.

Figure 5:
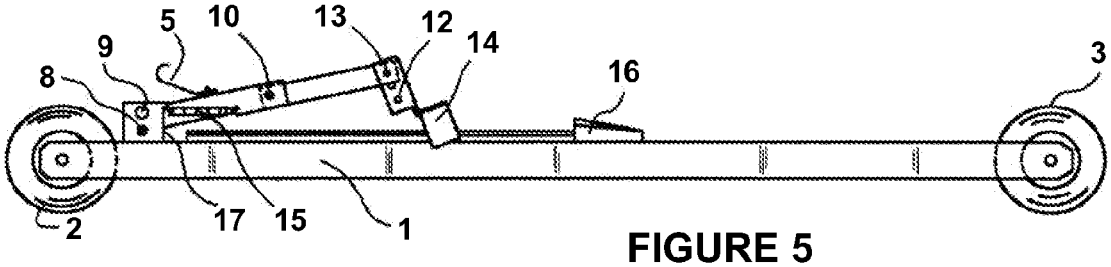
FIG. 5 is a side view of the brake folded over the frame of the roller ski.
Figure 8:
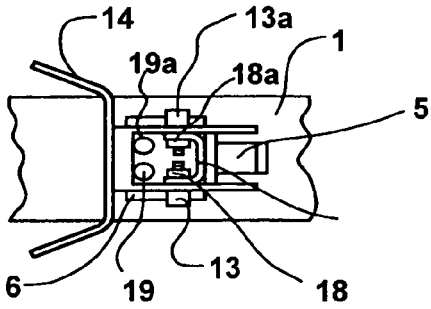
FIG. 8 is a top view of the braking system.
Figure 9:
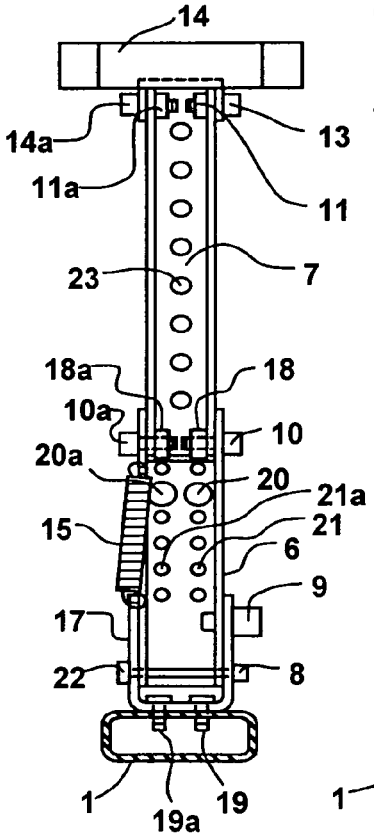
FIG. 9 is another end view of the braking system.

FIG. 5 shows the brake with plunger pin 9 pulled out and the structure folded about pivot pin 8, so yoke member 14 rests on the platform 1.

Referring to FIGS. 6, 7, 8, 9 and 10 these show more detailed views of one embodiment. In the embodiment shown joined members 17, 6,7 and 14 are U shaped and produced in aluminum. Holes 23, serve no purpose except to make the structure lighter. U shaped mounting support 17 is shown attached to frame 1, via mounting screws 19. Since ski bindings must be mounted to the top of the frame, all roller ski frames are designed to accept standard self tapping mounting screws.

Mounted to the U shaped support 17, via threaded pivot pin 8 and nut 22, is lower member 6 which is held in the upright position by the tension of extension spring 15 and by the spring loaded plunger 9, which contacts one side of member 6 and is fastened to U shaped support 17.

Attached to member 6 is brake pad 5 which can be moved to different vertical positions on member 6 via screw holes 21 and 21*a* which are vertically located, in pairs, on member 6. In one embodiment brake pad 5 has threaded holes to accept screws 20 and 20*a*. Brake pad 5 is constructed of heat treated steel with a minimum hardness of Rockwell 50C.

Figure 6:
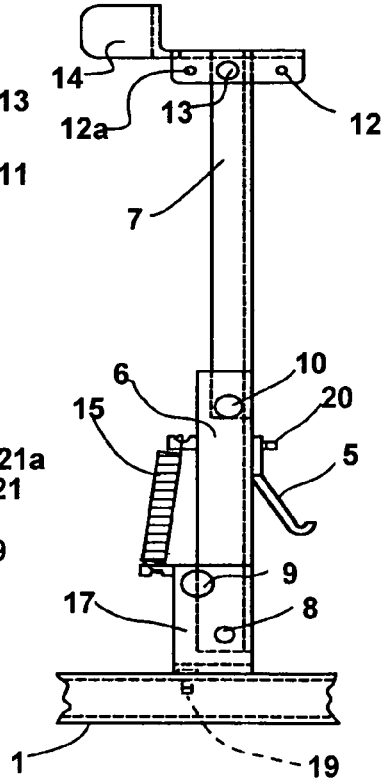
FIG. 6 is a side view of the braking system.
Figure 7:
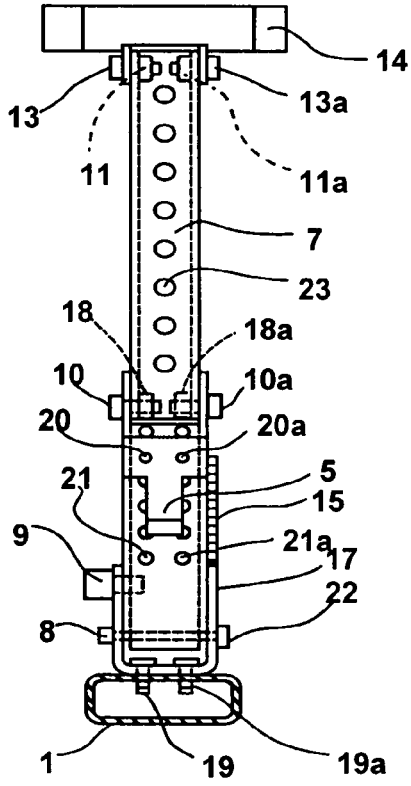
FIG. 7 is an end view of the braking system.

In the embodiment shown, spring loaded plunger 9 is a standard commercially available unit which is fastened to the U shaped member 17. Spring 15 is attached to U shaped member 17 and to lower member 6 as shown in FIG. 6.

In the design depicted, member 7 is fastened to member 6 by socket screws 10. Lower member 6 has clearance holes for the screws 10, while the upper member 7 contains commercially available press fit nuts 18, which accept the socket screws 10.

Member 7 is angularly adjusted, with respect to lower member 6, to fit the leg anatomy of different users. When properly adjusted, the clamping force generated by the socket screws 10 and nuts 18, joins member 7 and member 6 so they become an integral unit rotating about pivot pin 8.

Figure 10:
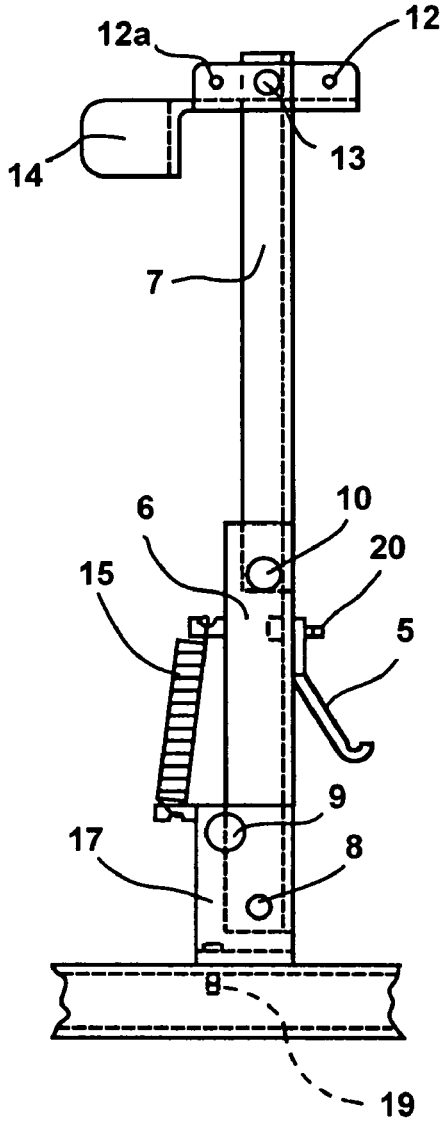
FIG. 10 is a side view of the brake with the upper member rotated 180 degrees.
Figure 11:
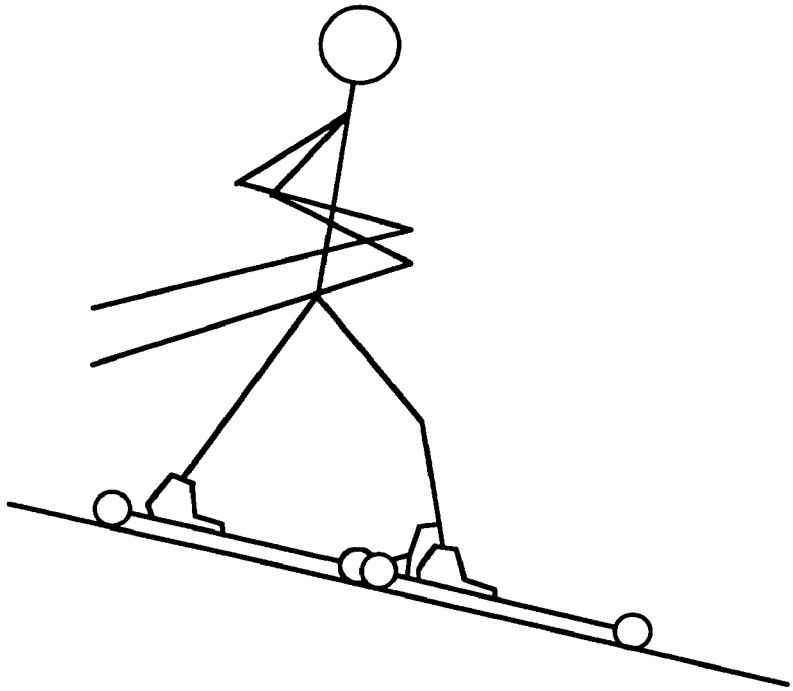
FIGURE 11 (PRIOR ART)
FIG. 11 is a schematic side view showing the body position of a user of the roller ski of FIGS. 2, 3 and 4 during braking.
Figure 12:
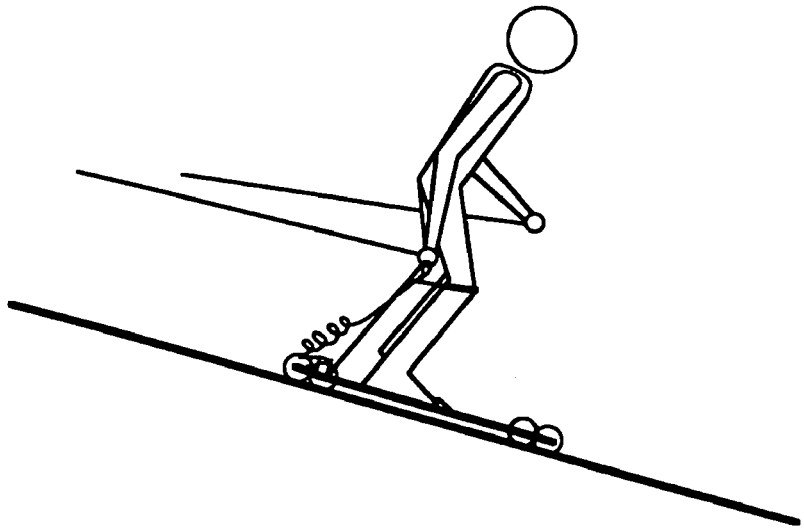
FIG. 12 is a schematic side view of a hand actuated brake of prior art.

In the embodiment depicted, yoke assembly 14 is attached to upper member 7 by socket screws 13 which are threaded into nuts 11 of member 7. Yoke 14 has several holes 12, for greater adjustability of the yoke with respect to the user's leg anatomy. In one embodiment yoke assembly 14 is configured so it can contact the leg in a lower position by rotating yoke 14 180 degrees and fastening the yoke to member 7 as shown in FIG. 10.

What has been described herein is the preferred embodiment of the invention. This skilled in the art will understand that numerous changes may be made without departing from the spirit and scope of the invention.

The invention claimed is:

1. A braking mechanism for a roller ski which has a top surface and a bottom surface, an elongated foot supporting base having a front end and a rear end, a roller attached to the front end and to the rear end of the elongated base, and a binding attached to the top surface of the elongated base between the rollers at the rear end and the front end of the roller ski, the binding being used to attach a roller ski to the boot of a person using the roller ski, the roller ski braking mechanism comprising:

a support member which is attached to the top surface of the elongated base between the roller at the rear end of the elongated base and the rear of a the boot attached to the binding;

a lower member having a top end and a bottom end, the bottom end of which is pivotally attached to the support member with a first pin, the lower member being generally perpendicular to the elongated base when the roller ski is to be used;

an actuating member which is pivotally attached to the top end of the lower member with a fastening means, the actuating member can be adjusted to an angular position with relation to the lower member to accommodate a person using the roller ski and then the actuating member is locked in the last mentioned angular position using a screw;

a braking member attached to the lower member adjacent to the roller at the rear end of the elongated base of the roller ski; and a second pin that is moved to permit the lower member and the actuating member attached to the lower member to rotate about the first pin in a direction toward the front end of the roller ski until they rest on the top surface of the elongated base of the roller ski, wherein when the person using the roller ski and having a foot in the boot attached to the binding pivots the lower part of the person's leg rearward about the person's ankle, the lower part of the person's leg presses against the actuating member and thereby pivots the lower member about the first pin toward the rear end of the elongated base of the roller ski and this causes the braking member to contact the surface of the roller at the rear end of the roller ski and this creates a braking action slowing the rotation of the roller.

2. The braking mechanism for a roller ski in accordance with claim 1 wherein the actuating member comprises an upper member and a yoke, and the yoke is adjustably attached to the upper member with the fastening means.

3. The braking mechanism for a roller ski in accordance with claim 2 wherein the fastening means that pivotally attaches the actuating member to the upper end of the lower member also permits the actuating member to be adjusted with respect to the lower member.

4. The braking mechanism for a roller ski in accordance with claim 1 wherein the fastening means that pivotally attaches the actuating member to the upper end of the lower member also permits the actuating member to be adjusted with respect to the lower member.

5. A braking mechanism for a roller ski which has a top surface and a bottom surface, an elongated foot supporting base having a front end and a rear end, a roller attached to the front end and to the rear end of the elongated base, and a binding that is attached to the top surface of the elongated base between the rollers at the rear end and the front end of the roller ski, the binding being used to attach a roller ski to the boot of a person using the roller ski, the roller ski braking mechanism comprising:

a support member which is attached to the top surface of the elongated base between the roller at the rear end of the elongated base and the rear of a boot attached to the binding;

a braking arm having a top end and a bottom end, the bottom end of which is pivotally attached to the support member with a first pin (8), the braking arm being generally perpendicular to the elongated base when the roller ski is to be used;

a braking member attached to the braking arm adjacent to the roller at the rear end of the elongated base of the roller ski; and a second pin and when the second pin is moved it permits the braking arm to rotate about the first pin in a direction toward the front end of the roller ski until it rests on the top surface of the elongated base of the roller ski, and wherein when the person using the roller ski and having a foot in the boot attached to the binding pivots the lower part of the person's leg rearward about the person's ankle, the lower part of the person's leg presses against the braking arm and thereby pivots the braking arm about the first pin toward the rear end of the elongated base of the roller ski, this causes the braking member to contact the surface of the roller at the rear end of the roller ski and this creates a braking action slowing the rotation of the roller.

6. The braking mechanism for a roller ski in accordance with claim 5 wherein the braking arm comprises a yoke that is generally U-shaped and the lower part of the leg of a person using the roller ski and having their foot in the boot will rest in the U-shaped portion of yoke when they pivot the lower part of their leg rearward about their ankle to thereby pivot the braking arm about the first pin toward the rear end of the elongated base of the roller ski to actuate the braking mechanism.

7. The braking mechanism for a roller ski in accordance with claim 6 further comprising spring means that biases the braking arm forward toward the front end of the elongated base of the roller ski to keep the braking member out of contact with the roller when the person using the roller ski does not wish to actuate the braking mechanism and slow the rotation of the roller.

8. The braking mechanism for a roller ski in accordance with claim 7 wherein the braking arm is adjustable to accommodate a person using the roller ski.

* * * * *